United States Patent [19]

Swearingen

[11] 4,152,092

[45] May 1, 1979

[54] ROTARY DEVICE WITH BYPASS SYSTEM

[76] Inventor: Judson S. Swearingen, 2235 Carmelina Ave., Los Angeles, Calif. 90064

[21] Appl. No.: 779,267

[22] Filed: Mar. 18, 1977

[51] Int. Cl.[2] ..... F01D 5/14; F03B 11/08; F04D 29/08; F04D 29/22

[52] U.S. Cl. ..... 415/53 R; 415/115; 415/169 A; 415/172 R; 277/15

[58] Field of Search ..... 415/169 R, 169 A, 168, 415/110, 115, 172 R, 170 A, 170 B, 53 R, 97; 277/15

[56] References Cited

U.S. PATENT DOCUMENTS

| | | | |
|---|---|---|---|
| 2,276,077 | 3/1942 | Jacobsen | 415/53 R |
| 2,741,991 | 4/1956 | Disbrow | 415/53 R |
| 3,635,581 | 1/1972 | Nichols | 415/169 A |

FOREIGN PATENT DOCUMENTS

| | | | |
|---|---|---|---|
| 511398 | 5/1952 | Belgium | 415/170 A |
| 1026916 | 3/1958 | Fed. Rep. of Germany | 415/168 |
| 972528 | 8/1930 | France | 415/170 A |
| 1130511 | 10/1956 | France | 415/53 R |
| 69453 | 7/1958 | France | 415/53 R |

*Primary Examiner*—C. J. Husar
*Assistant Examiner*—Donald S. Holland
*Attorney, Agent, or Firm*—Browning, Bushman & Zamecki

[57] ABSTRACT

A rotary fluid handling device, such as a turbine or a compressor, comprising a stationary body and a rotor rotatably mounted therein. The rotor has a flowway therethrough having a radially extending end. An annular seal coaxially surrounds the rotor within the stationary body axially distal the radially extending flowway end. The device further comprises a bypass passageway system having an inlet communicating with the area between the rotor and the stationary body on the axially opposite side of the seal from the radially extending flowway end and an outlet communicating with the flowway. The inlet opens at least partially radially outwardly into the stationary body.

18 Claims, 2 Drawing Figures

ROTARY DEVICE WITH BYPASS SYSTEM

BACKGROUND OF THE INVENTION

1. Field of the Invention

The present invention pertains to rotary fluid handling devices such as radial turbines, turbo-expanders, centrifugal compressors, and the like comprising a stationary body or stator enclosing a rotor having a plurality of openings extending radially thereinto. The radial openings may each form one end of a respective flowway curved so that the opposite ends thereof are substantially axially directed, or the radial openings may all communicate with a common generally axial channel. Annular seals are typically provided on both sides of the radially directed ends of these flowways. These seals are typically of the labyrinth type through which leakage occurs. The fluid thus leaking through the seals often contains entrained dust and other particles, particularly at start-up of the machine.

Such particles leaking past one of the seals may become trapped in the area behind the rotor. Even when passages through the rotor are provided for the purpose of venting this area to the "eye" of the rotor, the particles are not removed therethrough. This is because the natural flow patterns of the particles will not carry them into the rotor passages. Centrifugal force also keeps the particles in circulation so that eventually they erode the seal and/or the adjacent areas of the machinery cooperative therewith.

2. Description of the Prior Art

In the past, several systems for dealing with this erosion problem have been developed, but none has been entirely successful. One of these attempted to intercept and collect the particles before they reached the seal and direct them into the rotor discharge or to some other suitable site. In other prior systems, large pockets were provided upstream of the seal which the particles could enter and "get lost." The failure of such approaches was due to the fact that they were dependent on removal of the particles before they reached the seal. Since complete removal of the particles in this manner was impossible, some particles would still leak past the seal, become trapped behind the rotor, and erode the seal area while being circulated by centrifugal force, etc.

SUMMARY OF THE INVENTION

In accord with the present invention, a bypass passageway system is provided for collecting the particles after they have leaked past the seal and directing them into the rotor flowway or flowways to be discharged thereby. Where one or more passages are provided in the rotor to vent the back of the rotor and control thrust loads, such passages can be incorporated into the bypass passageway system by further providing one or more other passages through the stator to direct tha particles into the rotor passage. The inlet to the bypass passageway system is preferably formed by the stator passage and opens at least partially radially outwardly into the stator so that the particles will naturally be directed into the inlet by centrifugal force. The particles are then swept through the stator passage and discharged adjacent the rotor passage which is located radially inwardly of the bypass passageway system inlet.

Overlapping flanges may be provided on the rotor and stator to direct the particles into the rotor passage and prevent their recirculation through the space between the rotor and stator and through the stator passage. Such recirculation can also be inhibited by proper sizing of the stator passage with respect to the leakage space through the seals so that the rate of flow through the seal exceeds that through the stator passage. In such case, any given particle will be permitted to circulate through the stator passage only once.

The positioning and configuration of the inlet and adjacent portion of the bypass passageway system is also important in assuring that substantially all of the particles which are thrown outwardly by centrifugal force are collected and properly directed through the bypass passageway system.

In some instances in which particles may tend to collect in the rotor passage or passages, such passages may be inclined radially outwardly toward their outlet ends in the rotor flowway(s) so that centrifugal force can assist in sweeping them through the rotor passage.

It can thus be seen that the present invention provides a unique system for protecting a seal from erosion by particles entrained in the process fluid of a turbo-expander, centrifugal compressor, or other similar rotary fluid handling device. In particular, the system does not depend on collection of such particles before they reach the seal to be protected, but rather collects such particles after they have leaked past the seal and directs them into the rotor flowways so that they are not continuously recirculated in the space between the rotor and stator downstream of the seal. The arrangement of the bypass system is such as to take maximum advantage of the natural flow tendencies of the particles and working of the machinery and may be incorporated in a more or less conventional device with a minimum of structural modification and consequent expense.

Accordingly it is a principal object of the present invention to provide an improved system for protecting a seal of a rotary fluid handling device from erosion.

Another object of the present invention is to provide such a system which is not dependent on the prevention of leakage of particles past the seal to be protected.

A further object of the invention is to prevent continuous recirculation of particles through the space between the rotor and the stator.

Still another object of the invention is to provide a seal protecting system including bypass passages configured and located to take maximum advantage of the natural fluid flow tendencies in the machinery.

Yet another object of the invention is to provide a truly effective seal protective system which does not unduly increase the cost of the machine in which it is incorporated.

Still other objects, features, and advantages of the present invention will be made apparent by the following description of the preferred embodiments, the drawings and the claims.

DESCRIPTION OF THE PREFERRED EMBODIMENTS

Figure 1:
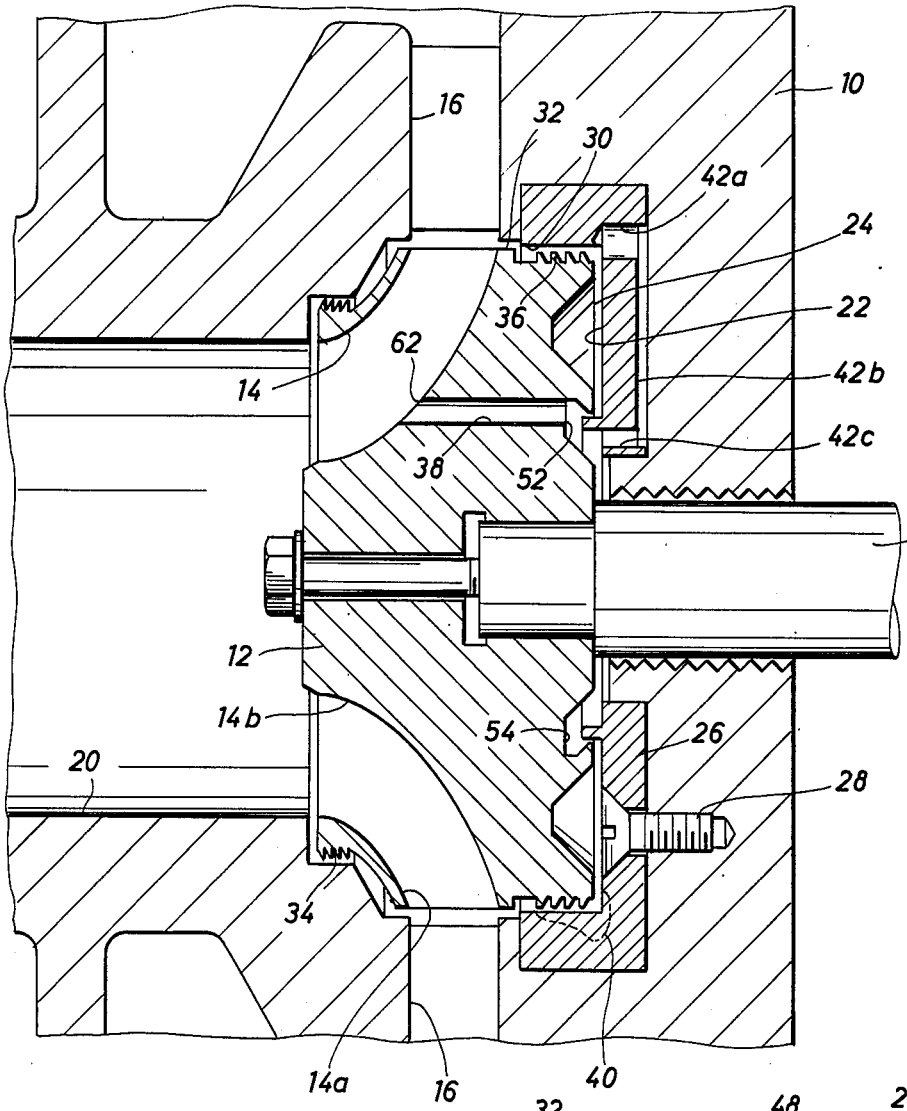
FIG. 1 is a longitudinal cross-sectional view of a turbo-expander according to the present invention.

Referring now to FIG. 1 there is shown a portion of a radial turbine comprising a stationary body or stator 10 and a rotor 12 rotatably mounted in the stator 10. The rotor 12 has a plurality of flowways 14 therethrough. Each of the flowways 14 has a generally radially directed inlet end 14*a* located intermediate the axial extremities of the rotor 12. From inlet end 14*a* each flowway 14 curves radially inwardly and axially outwardly to a generally axially directed outlet end 14*b*. The stator 10 has a plurality of nozzles 16 in register with the inlet ends 14*a* through which the process fluid is introduced tangentially to the flowways 14. As the process fluid passes through the flowways 14, it causes the rotor 12 to rotate thereby driving the output shaft 18 on which rotor 12 is mounted. The process fluid is then discharged axially through a portion of a longitudinal bore 20 through the stator 10. The portion of bore 20 in which rotor 12 is located is enlarged and configured to generally parallel the contour of the rotor. On the opposite side of rotor 12 from the discharge portion, bore 20 is substantially reduced in diameter to receive the shaft 18. The shoulder thus formed within the stator 10 presents a generally axially directed face 22 opposed to the axially directed rear face 24 of the rotor 12. Face 22 is formed by a wear ring 26 which is rigidly affixed to the main body portion of the stator 10 by screws 28.

Figure 2:
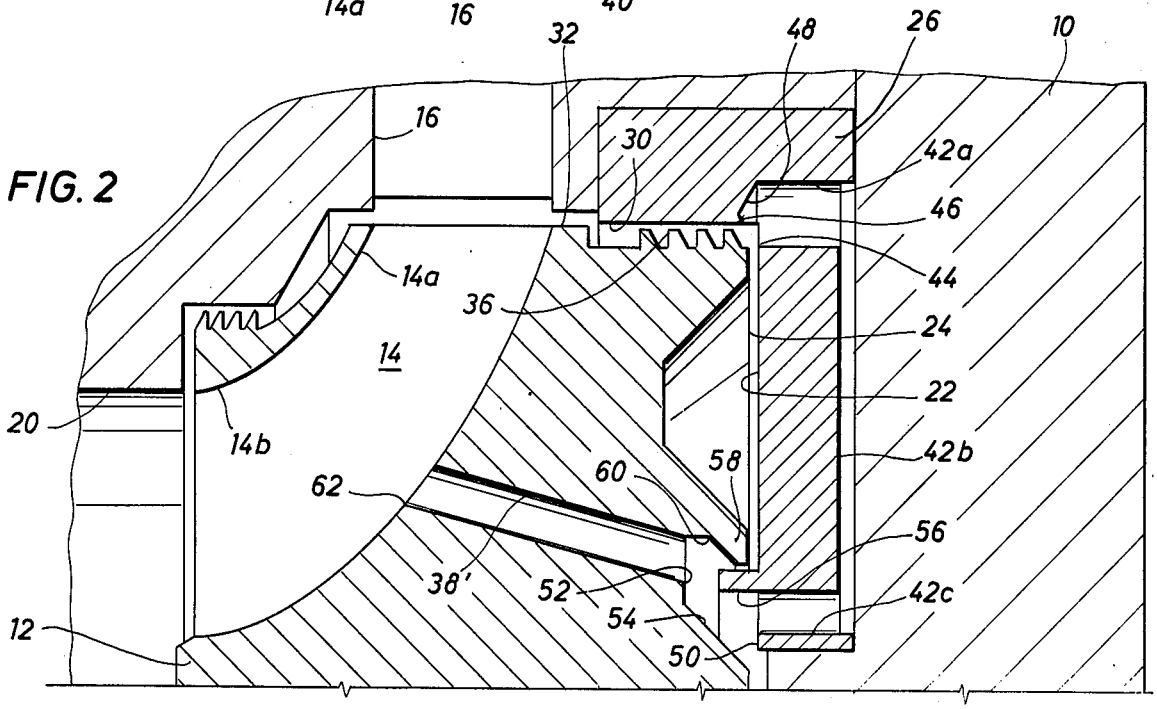
FIG. 2 is an enlarged view of the seal and bypass passageway system showing a modification thereof.

The stator 10 and rotor 12 also define respective opposed generally radially directed annular faces 30 and 32, face 30 being defined partially by wear ring 26 and partially by the main body portion of the stator 10. A pair of annular labyrinth seals 34 and 36 formed by and coaxially surrounding the rotor 12 are cooperative between faces 30 and 32 to control the leakage of fluid through the annular space between faces 30 and 32. Although seals 34 and 36 largely control such leakage and resulting thrust load problems which would otherwise be caused by fluid pressure, some leakage past the seals still occurs. Fluid leaking past seal 34 is free to pass radially inwardly across the small end of the rotor 12 and directly into the discharge portion of the bore 20. However fluid leaking past seal 36 into the annular space between axially directed faces 22 and 24 could eventually build up to an undesirable degree. Accordingly, one or more rotor passages are provided to vent the space between faces 22 and 24 to one or more of the flowways 14. Each passage 38 has an outlet end 62 communicating with the respective flowway 14 near the axially directed discharge end 14*b* thereof, i.e. in the "eye" of the rotor. As shown in FIG. 1, passages 38 are parallel to the rotor axis. FIG. 2 shows a modification in which, for reasons to be more fully explained below, the rotor passages 38' are each inclined radially outwardly from the space between faces 22 and 24 to an outlet end 62 in the flowway 14. However, in every other respect, the embodiment of FIG. 2 is identical to that of FIG. 1. Thus FIG. 2 may be referred to jointly with FIG. 1 to observe the details of all other parts of the seal and bypass system of the present invention.

The process fluid being handled by the turbo-expander often contains particles of solid matter such as dust which, along with the process fluid, leak past seal 36 and into the annular space between faces 22 and 24. This problem is particularly pronounced upon start-up of operations. Once in the annular space, the particles, in the absence of a bypass system such as is provided by the present invention, tend to be thrown radially outwardly by centrifugal force and to be swept along and circulated in the space just axially outwardly of the seal 36 by the spinning of the rotor 12. The phantom line 40 in FIG. 1 shows the pattern of erosion of the ring 26 caused by such circulating particles. Since the ring 26 cooperates with the labyrinthine formations 36 in providing a seal, such erosion effectively destroys such seal.

In order to prevent such erosion, a bypass passageway system is provided. This system includes a stator passage comprising a first branch formed by a bore 42*a* extending axially into the ring 26 and through the locus of intersection of faces 22 and 30 therein. Branch 42*a* thus includes an inlet 44 of the bypass passageway system which is located on the axially opposite sides of seal 36 from the radially extending ends 14*a* of the flowways, i.e. on the low-pressure side of the seal 36, partially in face 22 and partially in face 30. Thus the inlet 44 opens partially radially outwardly into the ring 26 which forms a part of the stator 10. The stator passage also comprises a channel 42*b* formed in the axially outer face of ring 26 in communication with the outer end of bore 42*a* and extending radially inwardly therefrom to communicate with a second radial bore 42*c* which also comprises a part of the stator passage. The outer ends of bores 42*a* and 42*c* and the open side of channel 42*b* are closed by the main body portion of the stator 10 when the ring 26 is affixed thereto.

The bypass passageway system also includes the rotor passage or passages 38 or 38'. While only one of the stator passages 42*a*, 42*b*, 42*c* is shown, it is possible to provide any number of such passages and, in particular, it is expedient to provide the same number if stator passages as rotor passages.

Particles in the space between faces 22 and 24 are propelled outwardly by centrifugal force and by virtue of a pressure vortex which is created in that space by the spinning fluid, the higher pressure being at the radially outer portion of the space. Since the inlet 44 opens partially radially outwardly into the stator, these forces will naturally tend to sweep the particles into the stator passage. The location of the inlet 44 at the radially outermost extremity of the annular space between faces 22 and 24, closely adjacent the seal 36, and partially in face 22 and partially in face 30, also helps to ensure that these particles will naturally fall into the inlet 44 and be directed away from the seal area to be protected. Such location, i.e. on the low pressure side of seal 36, also helps to draw particles through the seal so that they will not accumulate in and erode the upstream area between nozzles 16 and seal 36.

The portions of bore 42*a* adjacent inlet 44 are configured to further optimize the collection of particles. In particular, the portion of bore 42*a* immediately adjacent inlet 44 and face 30 is inclined axially inwardly, or toward seal 36, and radially outwardly as indicated at 46. Surface 46 is intersected, distal face 30, by another surface 48 inclined further radially outwardly but also axially outwardly, i.e. away from seal 36. By virtue of this configuration, the moving particles, especially any which are sliding axially inwardly along face 30, tend to be "scooped" up by surface 46 and directed into the bore 42*a*. Additionally, the surface 46 helps to prevent the particles from bouncing out of the bore 42*a*, while the surface 48 gradually diverts their movement in the axially outward direction toward channel 42*b*.

The area of inlet 44 should be no larger than, and preferably slightly smaller than the transverse cross-sectional area of passage 42*a*, 42*b*, 42*c* at any other point along its length to ensure proper flow of particles along that passage. If inlet 44 is too large, the particles may "bounce" out of the bore 42*a*. On the other hand, if the remainder of the passage is too large, the particles may not be satisfactorily swept along.

After the particles enter the bore 42*a*, they are swept by their own momentum and the circulating gas along channel 42*b* and bore 42*c* and thus directed into the rotor passage 38 or 38'. The flow of the process fluid through flowway 14 may help to draw the particles through passage 38 and into flowway 14. Even if there is no net flow through the space between faces 22 and 24, flow of fluid and the entrained particles through passage 38 or 38' is encouraged by the fact that the particles exiting from the stator passage are accelerated and thus pressurized by virtue of their intimate assocation with the spinning rotor.

The end 50 of bore 42*c* which communicates with the space between faces 22 and 24 is referred to herein as the juncture end of the stator passage 42, 42*b*, 42*c*. Passage 38 (or 38') likewise has a juncture end 52 communicating with that space via an annular recess 54 in face 24 the recess extending axially inwardly. An annular stator flange 56 extends axially inwardly into recess 54 from the radially outer side of bore 42*c*. Flange 56 thus directs the flow from bore 42*c* into passage 38 or 38' and blocks the flowing matter from beng again thrown outwardly by centrifugal force through the space between faces 22 and 24. A rotor flange 48 is formed within recess 54 at the radially outer wall thereof and extends radially inwardly toward the stator flange 56 intermediate its axial extremities. Flange 58 serves to further prevent passage of particles from bore 42*c* radially outwardly through the space between faces 22 and 24 and also defines a gutter 60 about the radially outer side of recess 54 adjacent the free edge of flange 56 to collect such particles and direct them into passage 38 or 38'. It can be seen that the positioning of bore 42*c* adjacent but slightly radially inwardly of the juncture end 52 of the rotor passage 38 or 38', the positioning of flange 56 on the outer side of bore 42*c*, and the positioning of the flange 58 and gutter 60 on the outer side of recess 54 all cooperate with the natural tendency of the particles to begin flowing radially outwardly as they leave the bore 42*c*.

Another feature of the present system which helps to prevent the recirculation of particles through the bypass passageway system involves the sizing of the stator passage 42*a*, 42*b*, 42*c*. If such passage is sized so that the flow rate therethrough is less than the flow rate through the seal 36, recirculation of any given particles through the stator passage after having passed once therethrough will be virtually precluded. In general, this can be best accomplished by making the effective flow area of the stator passage, i.e. the smallest transverse cross-sectional area of the passage, small enough so that the flow through the passage is less than half that through the seal 36.

It will be apparent that the system of the invention thus provides several backup expedients which in effect provide complete assurance that particles will not be continuously recirculated in the area adjacent seal 36. In the first place, as explained above, the inlet 44 and surfaces 46 and 48 assure that substantially all of the particles will enter the stator passage once they are thrown outwardly by centrifugal force after having passed seal 36 and entered the space between faces 22 and 24. The flanges 56 and 58, as positioned relative to the passage juncture ends 50 and 52 and the recess 54 together with the sizing of the stator passage secondly assure that the particles exiting from the stator passage will enter rotor passage 38 or 38' and not again move outwardly through the space between faces 22 and 24 toward the area to be protected from erosion. Finally, it can be seen that if, for any reason, some small amount of particles should fail to enter inlet 44 initially, or some small amount of particles should re-enter the critical area, they have a "second chance" to be picked up by the bypass passageway system since its inlet 44 is located downstream of seal 36 in the area in which the particles would otherwise be trapped and, specifically, in a location to which they will naturally flow. Thus, the chance that any given particles will continuously circulate in the area adjacent the seal 36 is eliminated.

It can thus be seen that the system of the present invention provides an improved means of protecting a rotor seal from erosion from dust or other particles entrained in the process fluid. The system does not depend on the removal of such particles before they reach the seal. The system further takes maximum advantage of the parts already present in such rotary devices and of the natural flow characteristics of the substances therein. In particular, a vent passage which is ordinarily provided in the rotor can be incorporated in the bypass passageway system to serve as the rotor passage, although it is also possible to specifically form a rotor passage for the latter purpose. The formation of the stator passage can be achieved by means of relatively simple machining processes on a ring such as 26 which forms a part of the stator and thus involves minimum additional expense. Furthermore, if the passages and related parts are properly sized, shaped and positioned, no pump or other drive means is required to direct the flow through the passages; rather the fluid and entrained particles will automatically flow in the desired patterns when the device is in operation.

It will also be appreciated that numerous modifications of the preferred embodiments described above can be made without departing from the spirit of the invention. In particular, numerous types of seals other than labyrinth seals can be employed. Indeed the term "seal" is used herein in a very broad sense to include structures which merely impede fluid flow or create a pressure drop thereacross rather than completely preventing flow therepast. Accordingly, the term "seal" herein might include virtually any formation providing a restriction causing such a pressure drop, or even the mere spacing of the outer diameter of the rotor and the inner diameter of the stator in sufficiently close proximity to achieve this effect.

As previously mentioned, the invention can be applied not only to turbines but also to various other types of devices such as turbo-expanders, centrifugal compressors, centrifugal pumps, etc. Thus in some embodiments, the rotor will comprise a plurality of flowways, as in the embodiment shown above, while in other instances, such as in certain compressors, a single axial channel will communicate with plural radial openings any one of which may be deemed, in conjunction with the axial channel, to constitute flowway.

The number, configuration, and manner of forming the passages could also be altered consistent with the objectives to be achieved. Numerous other modifications will suggest themselves to those skilled in the art. Accordingly, it is intended that the scope of the invention be limited only by the claims which follow.

I claim:

1. A rotary fluid handling device comprising:

a stationary body;

a rotor rotatably mounted in said stationary body, said rotor having at least one flowway therethrough, said flowway having an end portion extending substantially radially into said rotor;

annular seal means coaxially surrounding said rotor, disposed within said stationary body, and axially spaced from said radially extending end of said flowway;

and means defining a bypass passageway system having an inlet communicating with the area between said rotor and said stationary body on the axially opposite side of said seal means from said radially extending end of said flowway, said inlet opening at least partially radially outwardly into said stationary body, and an outlet communcating with said flowway, a first portion of said passageway system, including said outlet, comprising a rotor passage extending generally longitudinally through said rotor, and a second portion of said passageway system, including said inlet, comprising a stator passage extending through said stationary body.

2. The device of claim 1 being a turbine.

3. The device of claim 1 being a centrifugal compressor.

4. The device of claim 1 wherein the area of said bypass passageway system inlet is less than the transverse cross-sectional area of said stator passage at any other point.

5. The device of claim 1 wherein said stator passage is sized to prevent a fluid flow rate through said stator passage greater than the fluid flow rate through said seal means.

6. The device of claim 5 wherein said seal means comprises a labyrinth seal, and wherein the fluid flow rate through said seal is more than twice as great as the fluid flow rate through said stator passage.

7. The device of claim 1 wherein said flowway includes an axially directed end on the axially opposite side of said seal means from said radially extending end.

8. The device of claim 7 wherein said rotor passage communicates with said flowway distal the radially directed

9. The device of claim 8 wherein said rotor passage is inclined radially outwardly toward said outlet.

10. The device of claim 1 wherein said rotor and said stationary body have opposed generally axially directed faces defining an annular space therebetween, said passageway system inlet communicating with said annular space adjacent the radially outer extremity thereof, and said rotor passage and said stator passage each having a juncture end communicating with said annular space radially inwardly of said inlet.

11. The device of claim 10 wherein said axially directed face of said rotor has an annular recess extending axially thereinto adjacent said juncture end of said rotor passage, and wherein said axially directed face of said stationary body has an annular stator flange extending axially therefrom into said recess, said juncture end of said stator passage being disposed radially inwardly adjacent said stator flange.

12. The device of claim 1 wherein said rotor comprises an annular rotor flange within said recess extending radially inwardly toward said stator flange intermediate its axial extremities whereby a gutter is formed in said recess adjacent the free edge of said stator flange.

13. The device of claim 10 wherein said stationary body includes an annular radially inwardly directed face intersecting the radially outer extremity of said axially directed face of said stationary body, wherein said rotor includes a radially outwardly directed face intersecting the outer extremity of said axially directed face of said rotor and opposed to said radially inwardly directed face of said stationary body, wherein said inlet of said passageway system is located at least partially in said radially inwardly directed face of said stationary body adjacent its intersection with said axially directed face of said stationary body, and wherein said stator passage is partially defined by a first surface inclined radially outwardly and axially toward said seal means adjacent the portion of said inlet located in said radially inwardly directed surface.

14. The device of claim 13 wherein said first surface is intersected distal said inlet by a second surface inclined radially outwardly and axially away from said seal means.

15. A rotary fluid handling device comprising:

a stationary body;

a rotor rotatably mounted in said stationary body, said rotor having at least one flowway therethrough, said flowway having an end portion extending substantially radially into said rotor;

annular seal means coaxially surrounding said rotor, disposed within said stationary body, and axially spaced from said radially extending end of said flowway;

and means defining a bypass passageway system having an inlet communicating with the area between said rotor and said stationary body on the axially opposite side of said seal means from said radially extending end of said flowway, said inlet opening at least partially radially outwardly into said stationary body, a portion of said passageway system, including said inlet, comprising a stator passage extending through said stationary body and sized to prevent a fluid flow rate through said stator passage greater than the fluid flow rate through said seal means.

16. The device of claim 15 wherein said seal means comprises a labyrinth seal, and wherein the fluid flow rate through said seal is more than twice as great as the fluid flow rate through said stator passage.

17. A rotary fluid handling device comprising:

a stationary body;

a rotor rotatably mounted in said stationary body, said rotor having at least one flowway therethrough, said flowway having an end portion extending substantially radially into said rotor;

annular seal means coaxially surrounding said rotor, disposed within said stationary body, and axially spaced from said radially extending end of said flowway;

and means defining a bypass passageway system having an inlet communicating with the area between said rotor and said stationary body on the axially opposite side of said seal means from said radially extending end of said flowway, said inlet opening at least partially outwardly into said stationary body, and wherein said passageway system is partially defined by a first surface inclined radially outwardly and axially toward said seal means adjacent the portion of said inlet closest to said seal means.

18. The device of claim 17 wherein said first surface is intersected distal said inlet by a second surface inclined radially outwardly and axially away from said seal means.

* * * * *